US005354253A

United States Patent [19]

Awbrey et al.

[11] Patent Number: 5,354,253

[45] Date of Patent: Oct. 11, 1994

[54] WATER FITNESS AND THERAPY DEVICE

[76] Inventors: Brian J. Awbrey; Kipp K. Dye, both of 122 Jason St., Arlington, Mass. 02174

[21] Appl. No.: 885,182

[22] Filed: May 19, 1992

[51] Int. Cl.[5] ..... A63B 31/00

[52] U.S. Cl. ..... 482/111; 482/58; 482/904

[58] Field of Search ..... 482/55, 40, 140, 111, 482/142, 91, 57, 904, 58; 273/26 R

[56] References Cited

U.S. PATENT DOCUMENTS 3,708,167 1/1973 Potgieter ..... 482/91
4,109,907 8/1978 Zito ..... 482/904
4,516,771 5/1985 Nau ..... 273/26 R
4,846,458 7/1989 Potts ..... 482/41
5,033,735 7/1991 Erickson ..... 482/140

*Primary Examiner*—Stephen R. Crow
*Attorney, Agent, or Firm*—Edwin H. Paul; Jerry Cohen

[57] ABSTRACT

A water fitness, exercise and therapy device (10) designed with adjustability to accommodate children, women and men with a variety of sizes and strengths, including a water inertial fan (31) that provides the resistance to motion used in a workout. The fan is adjustable to provide a range of high to low resistances to movement and further comprising attachments that are adjustably mounted to accommodate a variety of exercises.

15 Claims, 5 Drawing Sheets

WATER FITNESS AND THERAPY DEVICE

FIELD OF THE INVENTION

The present invention relates generally to an exercise and fitness device for use in water, e.g. a pool. The apparatus conveniently attaches to a pool ladder or the side of the pool itself. The invention allows a wide range of exercises for the body and is adjustable in positioning and resistance ranges to accommodate a variety of user's sizes and strengths, including children.

BACKGROUND OF THE INVENTION

The general rise in fitness awareness has led to an appreciation of the benefits of exercising in a water environment. The user may be partially or nearly completely submerged.

One of the benefits of the water is the buoyancy on the body, wherein the user exercises certain muscles with an effectively reduced gravity force on the body. In this way the energy needed to support the body is reduced therein placing more emphasis on muscles targeted by a specific exercise. Another advantage is the capability of water to maintain a reasonably constant body skin temperature.

A device presently in use is disclosed in U.S. Pat. No. 5,033,735 ('735), issued on Jul. 23, 1991, the '735 patent being a continuation of U.S. Pat. No. 4,875,673 ('673), issued on Oct. 24 1989, both invented by Curtis Erickson.

These patents teach a device which attaches at the side of a pool. The device has a partly submerged frame and typically mounts to a pool ladder. The upper part of the frame has fixed hand grips for exercises wherein the user pulls himself up partially out of the water, and a pivoting extension attached to the lower submerged part of the frame.

The pivoting extension has a range of positions of from 0° to 90° from the vertical as the extension pivots away from the pool wall. This extension has cylindrical structures wherein the user may, at least, perform sit-ups.

The Erickson devices are limited in position and flexibility. The hand grips and the pivot extension are not adjustable relative to each other or to the water surface after assembly. In addition, there are limited chest and leg exercises, and there is no provision to adjust the resistance to motion (that is, the force exerted by the user is not adjustable in these devices). In addition, these devices cannot be used for bar dips, and they have only limited ability to exercise the chest, triceps, lats (latissimus dorsi), back or leg muscles.

The known devices are simply not designed to accommodate children, women and men of different sizes and strengths. Nor are the known devices designed to provide an easily adjustable workout or exercise load thereby tailoring a specific workout regimen.

An object of this invention is to provide an improved water exercise and fitness device using water inertia, in addition to gravity, as a variable source of resistance to motion.

It is an object of this invention to provide exercise and fitness device for substantially the entire body, at least including the arms, chest, spine, legs, abdomen, hips and back.

It is another object to provide handgrips with adjustable positions for comfort and to provide a variety of gripping positions, and wherein the user may select how much of users body emerges from the water.

It is an object of this invention to provide an adjustable device whereby children, women and men of various sizes and strengths may be accommodated.

Another object of this invention is to provide submerged, adjustable exercise apparatuses for the arms, chest and lower back and extremities.

It is a further object of this invention to provide removable, adjustable attachments, at least including a bench, submerged bars and grips, foot rests, bicycle, stair-stepping and treadmill options, wherein the attachments provide a variety of exercises for substantially the whole body.

It is yet another object of to provide a device which is mounted to the pool ladder or at the pool side.

It is yet another object of to provide a device which is stable, durable, strong and long lived.

SUMMARY OF THE INVENTION

The foregoing objects are met in a new structure providing a substantially complete exercise station. This station, in a preferred embodiment, is adjustable regarding: depth in the water such that the user may determine how much or little of the user's body emerges during certain exercise routines; positioning and orientation of grips, bars and options to accommodate children, women and men of various sizes and strengths.

This invention provides for a variety of attachments which may be adjustably mounted to the device. In a preferred embodiment, at least the following attachments may be mounted in the present invention: a bicycle attachment, a stair-stepping, a treadmill, a dip bar, a leg extension/flexion bar attachment and a workout bench.

This invention utilizes, in a preferred embodiment, a submerged fan, with adjustable gearing, fan blade angles of attack or adjustable surface areas to provide an adjustable water resistance to motion. Herein water resistance is defined as a structure where motion displaces or moves water. The user may remain partially or fully submerged while engaging in a workout wherein the amount energy expended is adjustable via the fan. Here the user may use a variable water resistance and/or a fvariable gravity resistance for a heavy or a light workout.

The invention utilizes a frame constructed to mount to a pool ladder or directly to the side of the pool. The grips, bars, attachments and water resistance fan extend out from the frame into the pool ensuring no interference to full motion by the user. The frame is wide enough to ensure stability even for large people.

Other objects, features and advantages will be apparent from the following detailed description of preferred embodiments thereof taken in conjunction with the accompanying drawings in which:

DETAILED DESCRIPTION OF THE PREFERRED EMBODIMENTS

Figure 1A:
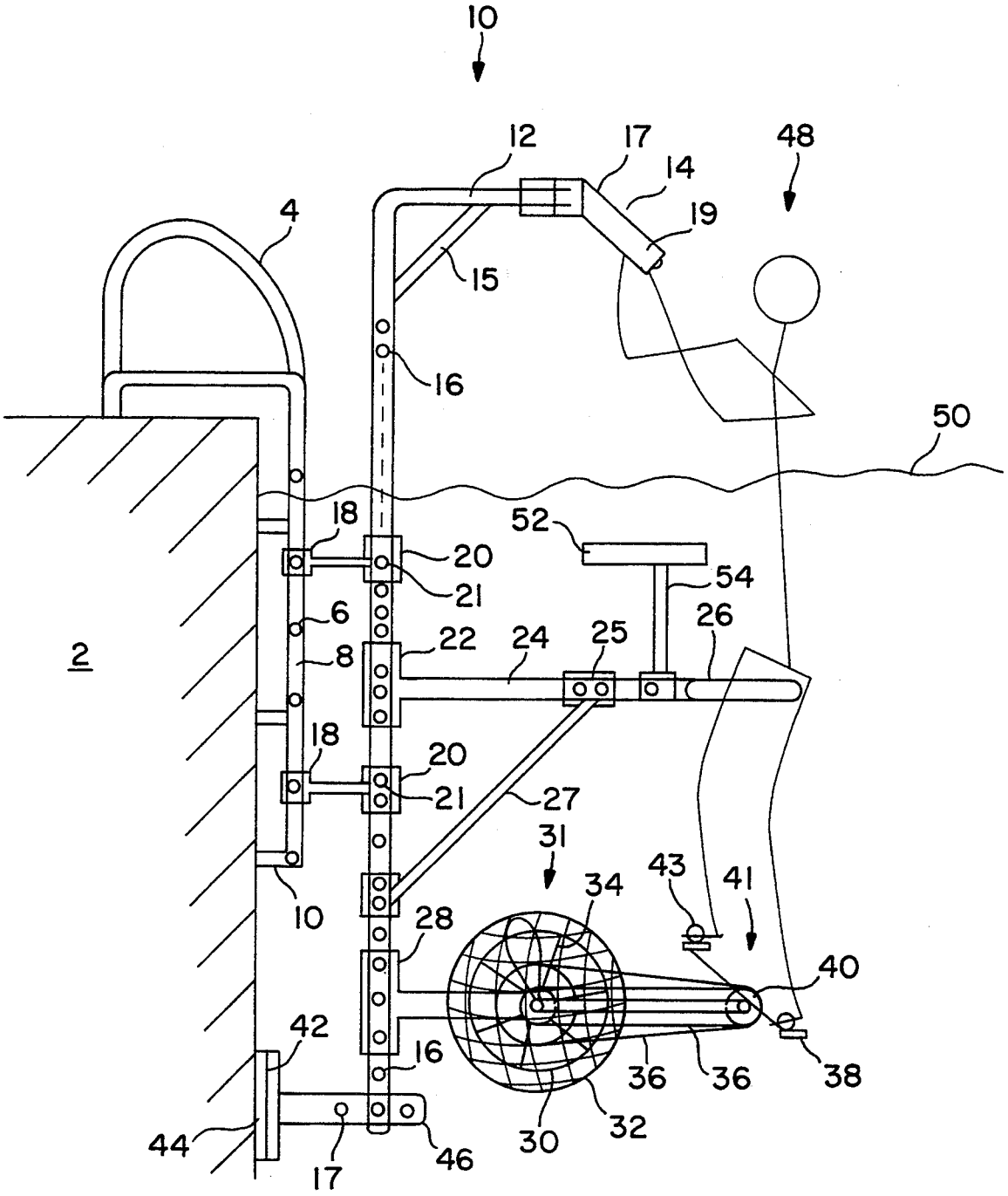
FIG. 1A is a pictorial of the invention attached to a pool ladder with a bicycle attachment.
Figure 1B:
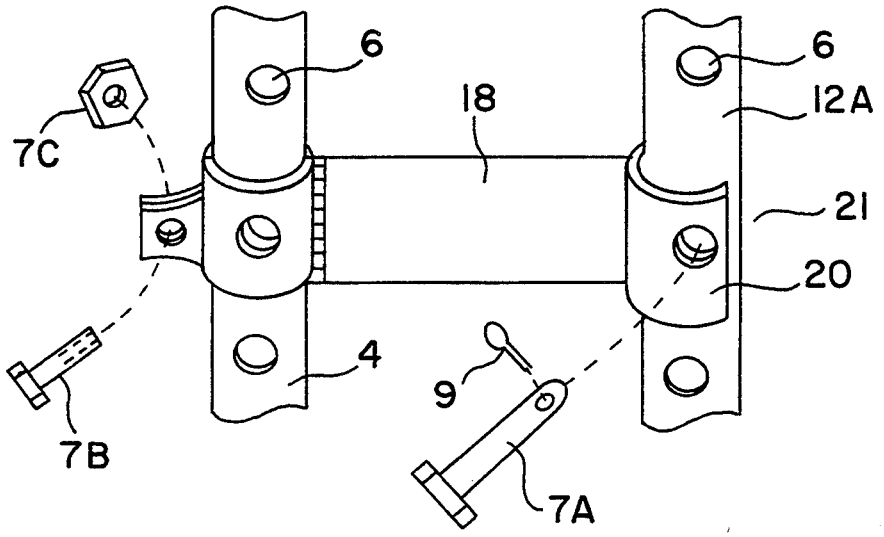
FIG. 1B is a detail of the sleeve bolt cotter pin adjustment assembly.

In FIGS. 1A and B, a fitness device 10 comprises a frame made of two stainless steel supports 12 (second support 12A hidden behind the first in FIG. 1A side view) clamped vertically to a pool ladder 8. The supports have a series of through holes 16 disposed along their length 12, and are attached to the ladder 8 by clamps 18. These clamps 18 are hinged with a holed tongue; the clamps attach to the ladder rungs or rails and are secured with a nut 7C and bolt 7D or the like. Extensions from the clamps project away from the ladder and end in a half-tubular sleeve 20. The sleeve contains through holes 21 suitable for accepting a bolt 7A or other securing cross member. By aligning the through holes with the through holes 16 in the supports 12, a bolt, or the like, is fitted through the holes 16 and 21 securing the frame 12 to the clamps and so to the ladder 4. FIG. 1B shows bolt 7A that is placed into the aligned through holes. A cotter pin 9 secures the bolts in the through holes. In another preferred embodiment a nut and bolt may be used, and in yet another preferred embodiment a bolt with a spring loaded internal (to the bolt) cotter pin-like arrangement may be used. Also, in another preferred embodiment the clamp 18 may be replaced with a ratcheting type clamp.

At the bottom of the supports a horizontal member 46 extends toward the side of the pool. This horizontal member 46, in a preferred embodiment is permanently fixed to the supports 12. The horizontal member has a plate 42 with a protective, resilient facing 44 that abuts the pool side wall to give added support at the lower end of the device. This lower member 46 is also useful in vertically aligning the device, and this lower member is especially important in installations where the ladder extends only a short distance beneath the water surface. In addition side supports (not shown) extending wider than the ladder may be added to give greater lateral stability.

Other types of adjustability may be used in place of, or in addition to, the arrangement of holes distributed along the lengths of the various members. Specifically the member 46 may end at the plate 42 with a threaded adjustment to allow firm abutment to the pool wall. Also ratcheted mechanisms may be used for finer positioning.

Also the sleeves 20 may be hinged or half cylinders allowing the sleeve to easily engage the supports 12 and 12A.

Movable attachment of the device 10 to the ladder 4 may be made by use of an arrangement of hinges and/or articulated parts to firmly engage the ladder 4. Other such techniques, known in the art, may be used.

Still referring to FIG. 1A, the tops of the supports 12 bend outward laterally over the pool, with support stays 15, as needed. The supports 12 end with a lateral gripping portion 14 and a downward angling gripping portion 19. The gripping portions are covered with resilient material 17 to ease grasping by the human hand. Neoprene is a preferred material for the covers.

At an adjustable position, shown below the water line 50, a structure 24 extends away from the pool edge. This structure terminates in a bicycle type seat 26 suitable for straddling by a human. The structure is movably attached with a sleeve 22, or other adjustable mechanism, to the supports 12. The sleeve has holes which align with the holes in the supports 12 allowing the structure 24 to be adjustable in the vertical dimension, as described before. The seat extension 24 may require in some preferred embodiments a stay 27 for support.

Below the seat structure another structure attached to the supports 12, in a similar adjustable fashion as described above, extends into the pool. This structure provides a fan-like mechanism 31 and an extension to a bicycle mechanism 41. The fan 31 has blades 34 which can be positioned full against the direction of rotation of the fan or at an angle thereby increasing or decreasing the resistance to movement of the fan through the water. Alternative preferred embodiments wherein the resistance to motion is adjustable include removing some of the fan blades, or by constructing a blade with adjustable holes, or the like, wherein the size of the holes are adjustable thereby increasing or decreasing the effective surface area. The effective surface area defined as that area which act to substantially impede the motion of the blade through the water. The bicycle extension has a sprocket 40 linked to the fan by a rubber belt 36. In another preferred embodiment a tooth free cylinder linked with a rubber belt 36 held by friction to the fan is utilized. As the pedals 39 are turned by the user 48 the belt drives the fan that provides resistance to the motion and so provides a workout for the user. The rubber band 36 may be replaced by a direct drive, chain or the like. The pedals are fitted with removable (VELCRO®) straps 43 for securing to the user's feet. Another preferred embodiment has an adjustable geared hub on the fan 31 or the sprocket 40, or different diameter cylinders for the rubber belt 36, that provides for an adjustable range of water resistances.

Alternatively a stair-step arrangement or a treadmill arrangement rather than the bicycle sprocket may be used, using the above described resistance mechanisms.

The user is shown grasping the grips 19 but hand grips 52 may be provided on extensions 26 vertically attached to the seat extension 24 to provide bicycle-like grips, positioned similarly to a bicycle handlebar. Other combinations (not shown) may be fitted to provide arm exercises while cycling.

Figures 1, 2C:
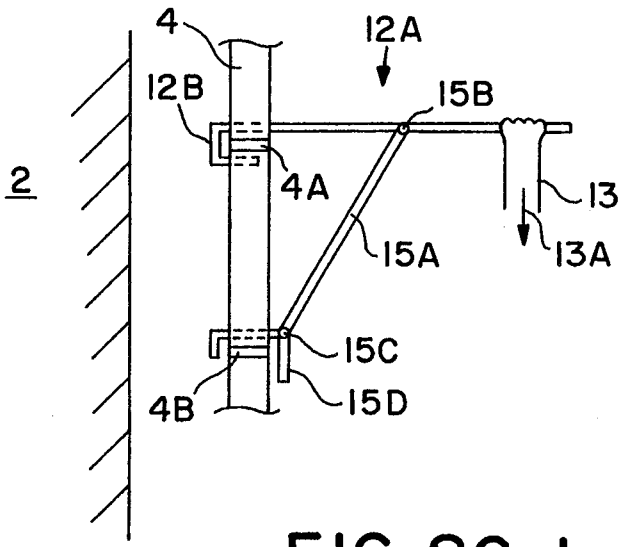
FIGS. 2C-1 and 2C-2 are top views of another preferred embodiment.
Figures 2, 2C:
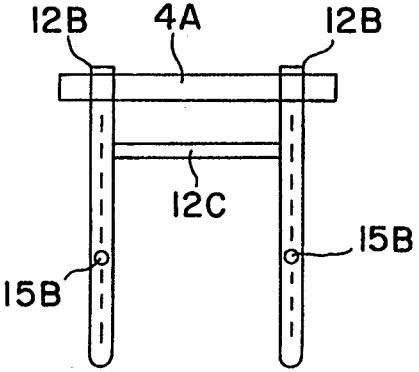
Figure 2A:
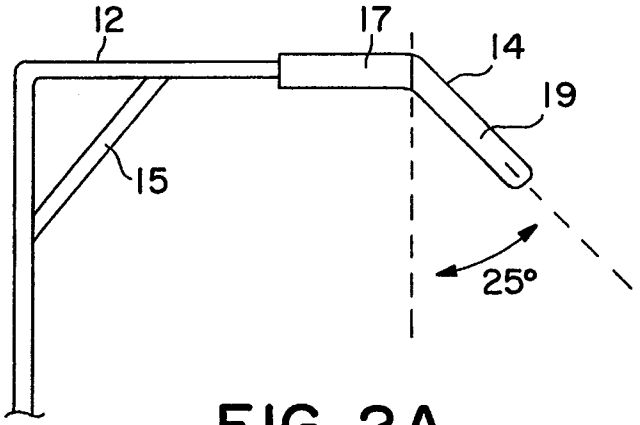
FIG. 2A is a side view of the upper part of the frame with the hand grips.
Figure 2B:
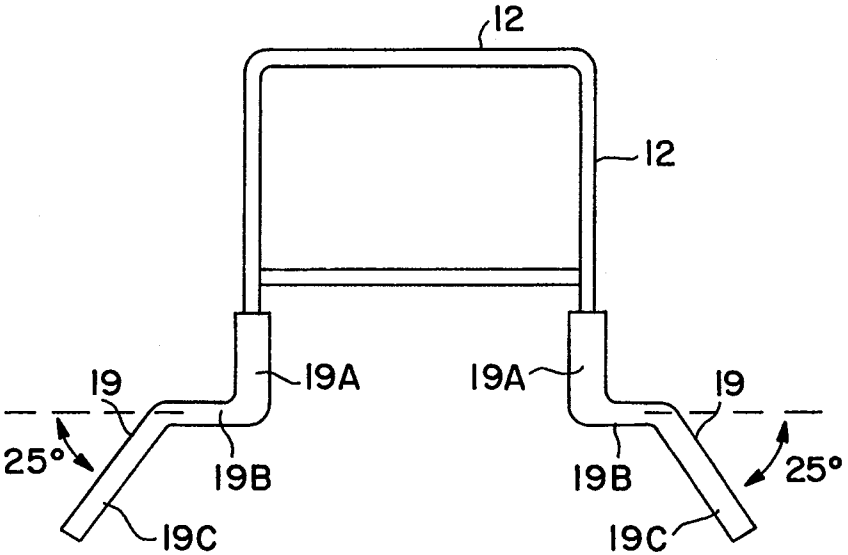
FIG. 2B is a top view of the upper part of the frame.

FIG. 2A is a detail view of the top of the supports 12 showing a stay 15. The supports 12 extend out from the vertical rise of the support 12 by about 30 inches and the gripping ends 19 are angled at about 25° from the vertical. A top view in FIG. 2B shows the grips 19 angled laterally at about 25° from the horizontal, and a neoprene covering 17 extends over the entire gripping end of the supports. The portion 19A allows the user to grip the round supports with the user's palm gripping in a direction substantially 90° from the front surface of the user's body, wherein pullups in this position have special value for the biceps and triceps. When the user grips the portion 19B the palms are substantially parallel with the front surface of the user's body, here the biceps (when the fingers point toward the body), and the lats and triceps (when the fingers point away from the body) are especially exercised by doing pullups. When the downward portions 19C are gripped, the pectorals, lats and other muscle grouping coordinate in the workout.

FIGS. 2C-1 and 2C-2 are another preferred embodiment wherein the top portion 12A of the frame is detachably mounted to the pool ladder steps 4A. A C shaped structure 12B wraps around the step 4A such that the downward acting forces generated by the user, depicted as a hand 13 pulling downward 13A on the bars 12A, act to retain the structure 12A to the step 4A. The supporting stay 15A is attached to the bars 12A by a sliding pivot 15B. This allows the point 15B is be moved along the bar 12A at the different required to allow the other end 15C of the stay to be positioned at a convenient step 4B. 15C is pivotly mounted to another C shaped structure that surrounds the step 4B wherein the forces generated by the user act to retain the structure 15D to the step 4B. A top view shows the two parallel support members 12A, including a horizontal member 12C needed for support and stability.

Figure 2D:
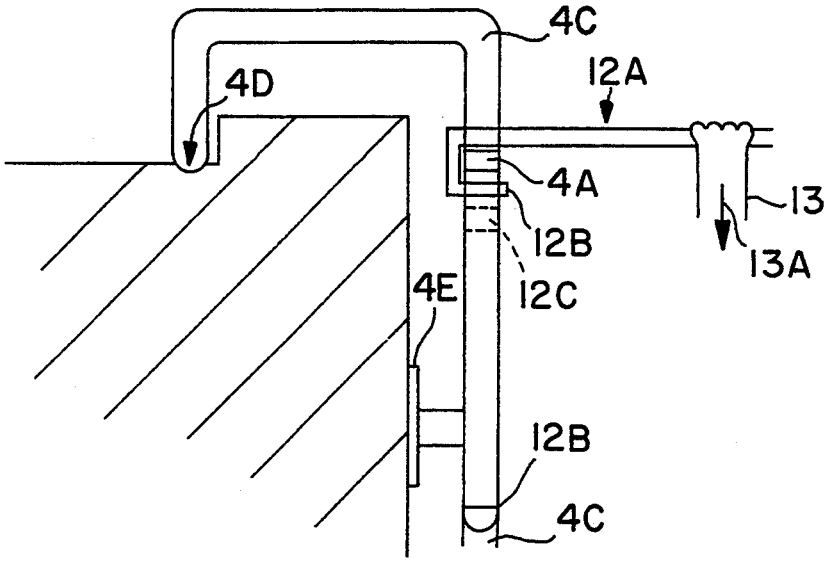
FIGS. 2D and 2E are side and front views of another preferred embodiment.
Figure 2E:
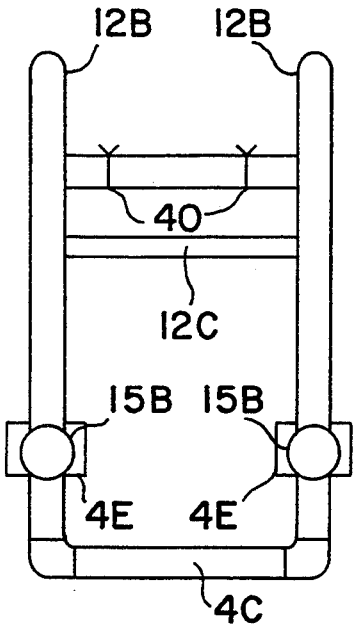

FIG. 2D show the top portion 12A of the frame detachably mounted to the pool deck. Two bolts 4D hold an optional detachable frame 4C to the deck. A C-shaped structure 12B wraps around the pool deck attachment 4C such that the user pulling downward on the hand grip 13 (hand shown 13A) acts to retain the structure 12A to the step 4A. A front view shows two horizontal members 12C and 4C that support the parallel sides 12B. The plates 4E rest against the pool side providing support for the entire structure.

Figure 3:
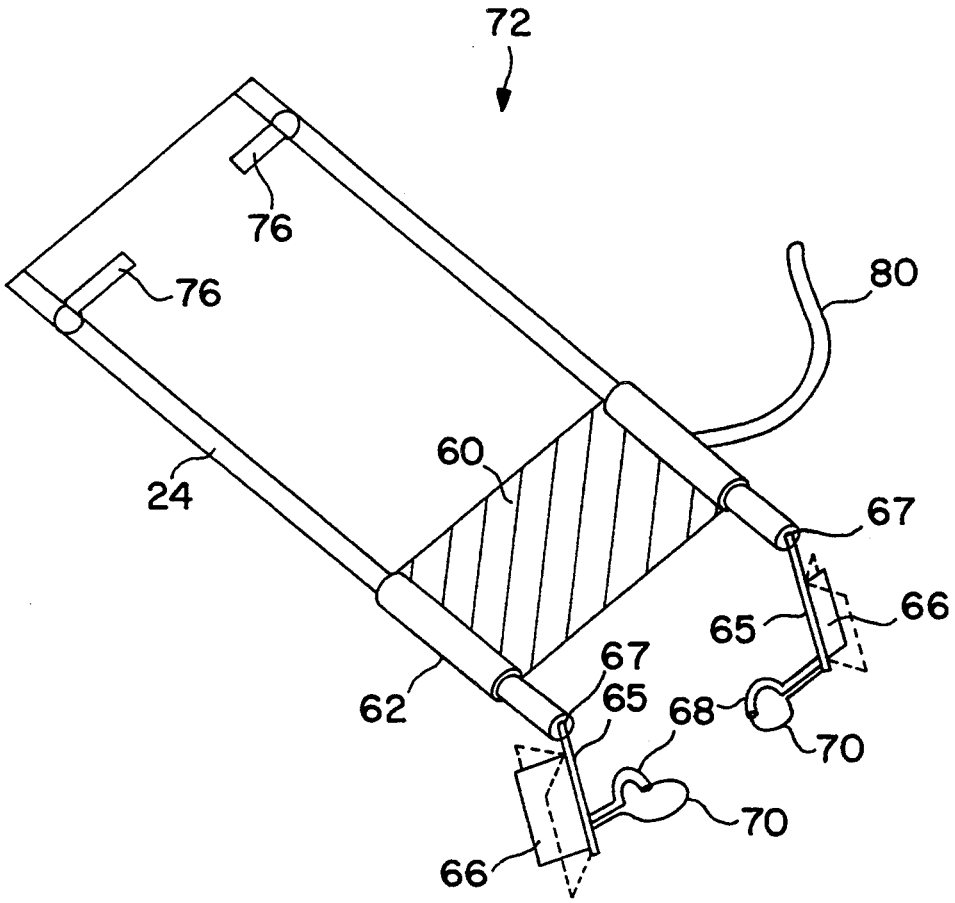
FIG. 3 is a pictorial of a bench/seat support extension.

FIG. 3 shows a bench type seat extension 72 for leg or abdominal exercises. When the user faces away from the pool edge sitting on the seat 60, the legs may be fastened into the clamps 68 by removable VELCRO® straps 70. The members 65 extend from the seat supports 24 by an articulated joint 67. This joint may be spring loaded (not shown) to provide resistance to motion. When the user is sitting he may grasp the overhead grips 19 shown in FIG. 1A for support. The extensions 65 have vanes attached 66 which have a settable angle of attack to adjust the resistance as desired. The user then alternately straightens and bends his legs forcing the vanes 66 through the water thereby exercising his legs. When the user faces the pool side wall his legs may be positioned under padded formed extensions 76 arranged for the user to perform situps. A VELCRO® belt 80 may be attached around the lower waist of the user for support.

Figure 4:
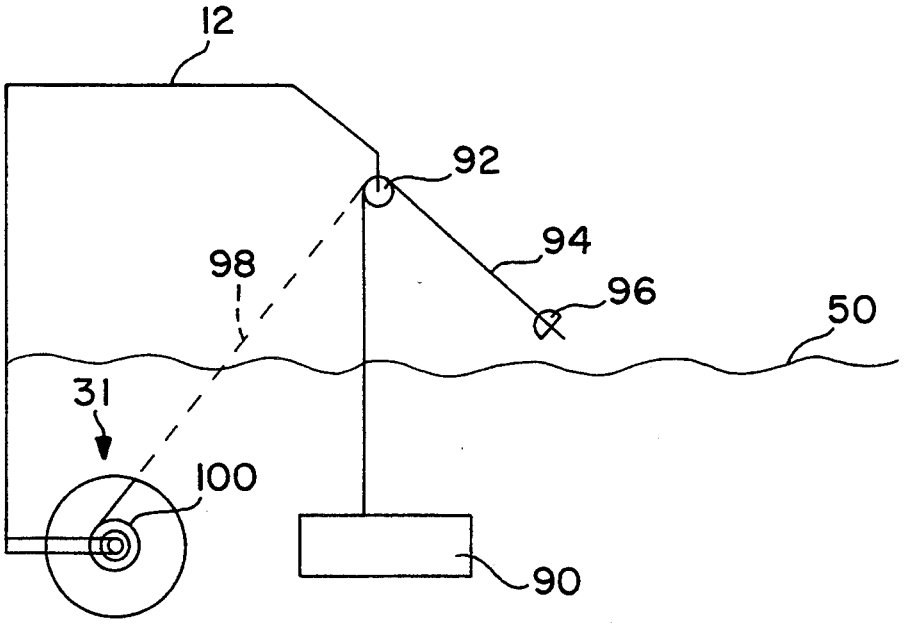
FIG. 4 is a pictorial of a weight/pulley attachment option.

FIG. 4 shows a pulley 92 system attached to the above water supports 12. There are ropes 94 ending in hand grips 96 with a water weight 90 at the other end. Alternatively the other end of the rope 96 may be attached to the fan 31 by a spring loaded hub around which the rope is wound.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A water fitness, exercise and therapy device for use in a pool and mounted on a pool wall, comprising:

(a) vertically adjustable frame means removably attached to a pool wall, said adjustable means having a plurality of positions on said pool wall, wherein the frame means may be positioned with at least a portion of the device out of the water at a desired height relative to the water surface, and (b) hand gripping means extending generally parallel to the water surface from said frame means, said gripping means being detachably arranged and constructed with at least one portion directed downwardly away from the pool wall, and canted downwardly and sideways away from one another so that the gripping means provides for a plurality of horizontal and angled hand gripping positions, from both arms being directly over the user with the hands together to both arms being about 180 degrees apart, whereby the user exercises by grasping the gripping means and lifting himself upwardly working against gravity and water resistance, thereby decreasing body buoyancy, as more of the user's body exits the water, and then resisting gravity as the user lowers himself back downwardly.

2. A device as defined in claim 1 further comprising:

(a) pulley means attached to said frame means, (b) flexible connection means, running over said pulley means, wherein one end of said connection means terminates in handle means, (c) water resistance means connected to the other end of said connection means, wherein the user by pulling on the handle means moves the resistance means thereby expending energy.

3. A device as defined in claim 1 further comprising:

(a) adjustable support means, extending from said frame means into said pool, removably attached to said frame means, wherein said support means may be positioned at a desired position to the water surface, wherein said support means is constructed and arranged for a user to sit or lie either facing the pool edge or away from the pool edge, and (b) adjustable lower support means removably attached to said frame means, wherein said support means may be positioned at a desired depth below or above the water surface.

4. A water fitness, exercise and therapy device for use in a pool and mounted on a pool wall, comprising:

(a) vertically adjustable frame means removably attached to a pool wall, said adjustable means having a plurality of positions on said pool wall, wherein the frame means may be positioned with at least a portion of the device out of the water at a desired height relative to the water surface, and (b) hand gripping means extending generally parallel to the water surface from said frame means, said gripping means being detachably arranged and constructed with at least one portion angled from the plane of the water surface, and wherein the gripping means provides for a plurality of horizontal and angled hand gripping positions whereby the user exercises by grasping the gripping means and lifting himself upwardly working against gravity and water resistance as more of the user's body exits the water, and then resisting gravity as the user lowers himself back downwardly;

(c) adjustable support means, extending from said frame means into said pool, removably attached to said frame means, wherein said support means may be positioned at a desired position to the water surface, wherein said support means is constructed and arranged for a user to sit or lie either facing the pool edge or away from the pool edge;

(d) adjustable lower support means removably attached to said frame means, wherein said support means may be positioned at a desired depth below or above the water surface;

(e) adjustable water resistance to motion means removably attached to said lower support means, wherein said resistance means provides a variable resistance to motion;

(f) means responsive to user motions; and (g) means for connecting said resistance means to said responsive means arranged and constructed wherein the user motion is resisted, thereby requiring the user to expend energy.

5. A device as defined in claim 4 wherein said responsive means comprises bicycle pedals and sprocket means adjustably and removably attached to said lower support means, wherein the user exerts pressure on the pedals and sprocket which move the resistance means.

6. A device as defined in claim 4 wherein said water resistance means comprises a fan means with blades adjustably set to provide an adjustable surface area thereby providing an adjustable resistance to motion of said fan.

7. A device as defined in claim 4 further comprising a plurality of gearing mechanisms wherein the resistance to motion is different for each gear.

8. A device as defined in claim 3 wherein said support means provides for a flat seat or a straddle (bicycle-like) seat wherein said user may be face toward the pool side wall or away from the pool side wall, and further comprising, first means adjustably and removably attached to said support, disposed toward said pool side wall, arranged and constructed for holding the legs or feet of the user, wherein the user, placed on the seat facing the pool wall, may perform sit-ups.

9. A device as defined in claim 8 wherein further comprising second means for holding the user's legs or feet adjustably and removably attached to said support disposed beyond said seat farther into the pool and below said seat, wherein the user placed on the seat facing away from the pool wall, may perform leg bending and extensions.

10. A device as defined in claim 9 further comprising vanes attached to said second leg or foot holding means, wherein said vanes are positioned to provide resistance to motion through the water.

11. A device as defined in claim 3 wherein said support means provides for a flat seat or a straddle (bicycle-like) seat wherein said user may be face toward the pool side, away from the pool side or at any angle therebetween, and further comprising:

(a) first means adjustably and removably attached to said support, disposed toward said pool side wall, arranged and constructed for holding the legs or feet of the user, wherein the user, placed on the seat facing the pool wall, may perform sit-ups, (b) second means for holding the user's legs or feet adjustably and removably attached to said support disposed beyond said seat farther into the pool and below said seat, wherein the user placed on the seat facing away from the pool wall, may perform leg flexions and extensions, and (c) vanes attached to said second leg or foot holding means, wherein said vanes are positioned to provide resistance to motion through the water.

12. A water fitness, exercise and therapy device for use in a pool and mounted on a pool wall, comprising:

(a) adjustable frame means removably attached to a pool wall, wherein the frame means may be positioned with at least a portion of the device out of the water at a desired height relative to the water surface, and (b) hand gripping means extending generally parallel to the water surface from said frame means, wherein said gripping means is arranged and constructed with at least one portion angled from the plane of the water surface, wherein the gripping means provides for a plurality of hand gripping positions, (c) pulley means attached to said frame means, (d) flexible connection means, running over said pulley means, wherein one end of said connection means terminates in handle means, (e) water resistance means or weight means connected to the other end of said connection means, wherein the user by moving the handle means moves the resistance means thereby expending energy, (f) adjustable support means, extending from said frame means into said pool, removably attached to said frame means, wherein said support means may be positioned at a desired position to the water surface, wherein said support means is constructed and arranged for a user to sit or lie either facing the pool edge or away from the pool edge, (g) adjustable lower support means removably attached to said frame means, wherein said support means may be positioned at a desired depth below the water surface, (h) adjustable water resistance fan means with blades adjustably set to provide an adjustable surface area thereby proving an adjustable resistance to motion to said fan, (i) bicycle pedals and sprocket means adjustably and removably attached to said lower support means, wherein the user exerts pressure on the pedals and sprocket which turn, (j) means for connecting said pedal and sprocket means to said water resistance means arranged and constructed wherein the user motion is resisted thereby requiring the user to expend energy, and (k) a plurality of gearing mechanisms cooperating and connected to said water resistance means or to said sprocket means, wherein the resistance to motion is different for each gear.

13. A device as defined in claim 1 further comprising:

(a) pulley means attached to said frame means, (b) flexible connection means, running over said pulley means, wherein one end of said connection means terminates in handle means, (c) weight means connected to the other end of said connection means, wherein the user by pulling on the handle means moves the resistance means thereby expending energy.

14. A water fitness, exercise and therapy device for use in a pool and mounted on a pool wall, comprising:

(a) adjustable frame means removably attached to a pool wall, wherein the frame means may be positioned with at least a portion of the device out of the water at a desired height relative to the water surface, and (b) hand gripping means extending generally parallel to the water surface from said frame means, wherein said gripping means is arranged and constructed with at least one portion angled from the plane of the water surface, wherein the gripping means provides for a plurality of hand gripping positions, (a) pulley means attached to said frame means, (b) flexible connection means, running over said pulley means, wherein one end of said connection means terminates in handle means, (c) weight means connected to the other end of said connection means, wherein the user by moving the handle means moves the resistance means thereby expending energy, (d) adjustable support means, extending from said frame means into said pool, removably attached to said frame means, wherein said support means may be positioned at a desired position to the water surface, wherein said support means is constructed and arranged for a user to sit or lie either facing the pool edge or away from the pool edge, (e) adjustable lower support means removably attached to said frame means, wherein said support means may be positioned at a desired depth below the water surface, (f) adjustable water resistance fan means with blades adjustably set to provide an adjustable surface area thereby proving an adjustable resistance to motion to said fan, (g) bicycle pedals and sprocket means adjustably and removably attached to said lower support means, wherein the user exerts pressure on the pedals and sprocket which turn, (h) means for connecting said pedal and sprocket means to said water resistance means arranged and constructed wherein the user motion is resisted thereby requiring the user to expend energy, and (i) a plurality of gearing mechanisms cooperating and connected to said water resistance means or to said sprocket means, wherein the resistance to motion is different for each gear.

15. A water fitness, exercise and therapy device as defined in claim 1, wherein said hand gripping means are arranged to be a sufficient distance apart that a user may grip said means with both arms being directly over the user with the hands together at 0 degrees apart to both arms being in a generally horizontal position in the axial plane 180 degrees apart.

* * * * *